US006554369B2

(12) United States Patent
Sollami

(10) Patent No.: US 6,554,369 B2
(45) Date of Patent: Apr. 29, 2003

(54) CUTTING TOOL WITH HARDENED INSERT

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 09/904,007

(22) Filed: Jul. 12, 2001

(65) Prior Publication Data

US 2003/0011236 A1 Jan. 16, 2003

(51) Int. Cl.[7] ..... E21C 35/19
(52) U.S. Cl. ..... 299/111; 299/113; 175/435
(58) Field of Search ..... 299/111, 113, 299/79.1, 101, 103, 81.1; 175/427, 426, 435

(56) References Cited

U.S. PATENT DOCUMENTS

| | | | | |
|---|---|---|---|---|
| 3,389,761 A | * | 6/1968 | Ott | 175/374 |
| 3,746,396 A | | 7/1973 | Radd | |
| 4,729,603 A | | 3/1988 | Elfgen | |
| 4,940,288 A | | 7/1990 | Stiffler | |
| 4,981,328 A | | 1/1991 | Stiffler | |
| 5,074,623 A | | 12/1991 | Hedlund | |
| D347,232 S | * | 5/1994 | Massa et al. | D15/138 |
| 5,324,098 A | | 6/1994 | Massa | |
| 5,484,191 A | * | 1/1996 | Sollami | 299/105 |
| 5,551,760 A | * | 9/1996 | Sollami | 299/105 |
| 5,702,160 A | | 12/1997 | Levankovskii | |
| 6,019,434 A | | 2/2000 | Emmerich | |
| 6,199,451 B1 | * | 3/2001 | Sollami | 175/426 |
| 6,199,956 B1 | | 3/2001 | Kammerer | |
| 6,375,272 B1 | * | 4/2002 | Ojanen | 299/110 |

FOREIGN PATENT DOCUMENTS

| | | |
|---|---|---|
| DE | 1915152 | 10/1970 |
| GB | 1071493 | 6/1967 |
| GB | 1101085 | 1/1968 |
| GB | 2041289 A | 9/1980 |

* cited by examiner

*Primary Examiner*—Thomas B. Will
*Assistant Examiner*—Daniel P Stephenson
(74) *Attorney, Agent, or Firm*—Robert L. Marsh

(57) ABSTRACT

A cutting tool has a tool body with a hardened insert brazed into a cylindrical seat having a given diameter at the forward end of the tool body. The insert has a cutting tip portion, a generally cylindrical base portion positioned behind the tip, and a frustoconical midsection extending from the tip section to the base section. The base section of the insert has a diameter substantially less than the diameter of the seat and a plurality of radial projection extending outward of the base section assist in aligning the base section within the seat prior to brazing the parts together.

4 Claims, 3 Drawing Sheets

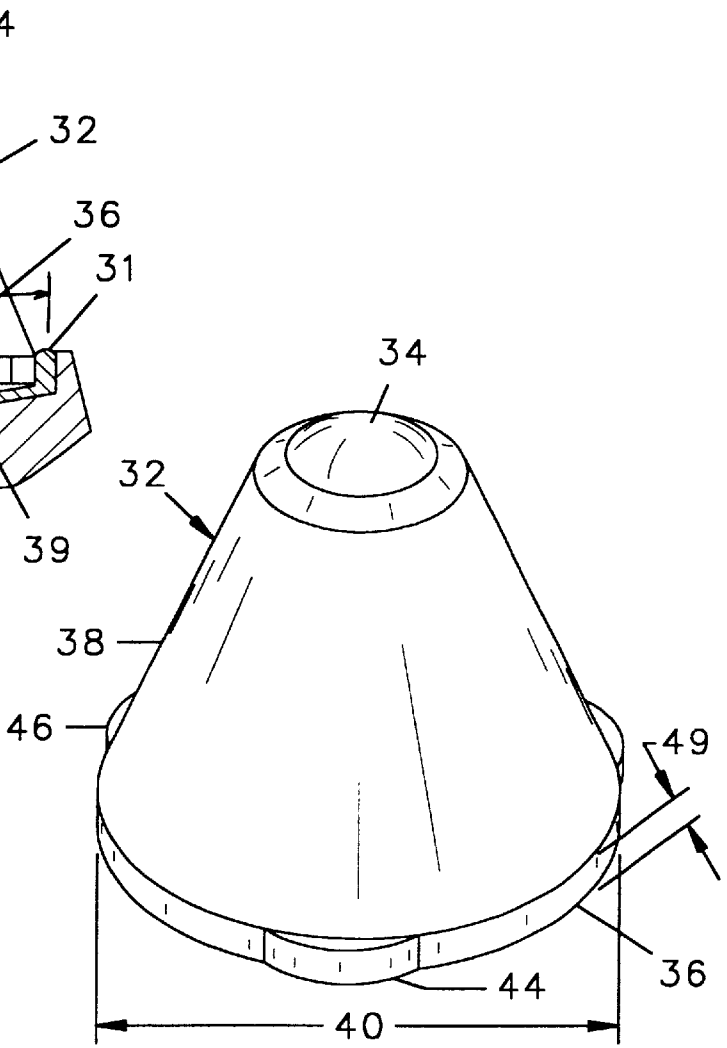
FIG. 2
FIG. 3
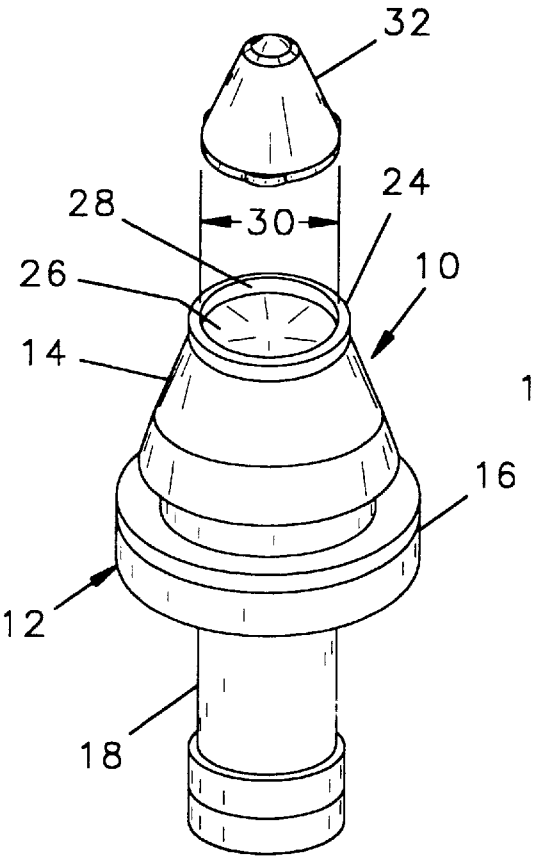
FIG. 1

CUTTING TOOL WITH HARDENED INSERT

The present application relates to cutting tools used to break up hard surfaces and to the tips incorporated in such tools,

BACKGROUND OF THE INVENTION

Hard surfaces such as concrete, asphalt and stone are broken up using machines having a rotating member, such as a wheel or a drum, and a plurality of tools located on the outer surface of the rotating member. When the rotating member is forced against the surface to be excavated, the cutting ends of the tools successively impact against the surface and break off small portions of the material, thereby advancing the cut.

The tools for such machines have a generally tapered cutting end behind which is a coaxially mounted cylindrical shank sized to rotatably fit within the cylindrical bore of a tool holder. The forward end of the cutting end of the tool body has a seat into which the base of a tungsten carbide cutting insert is brazed.

The hard surfaces against which the tools are forced cause the tool bodies and the inserts therein to become rapidly worn and it is common to replace all of the tools of a cutting machine after a single day's use. The machine may carry one hundred and fifty tools or more and it may wear out several thousand tools during a single construction season. Replacement tools, therefore, are made in standard sizes which fit into machines made by several manufacturers. The seat at the forward end of the standard tool body has an inner diameter of approximately 0.710 inches and the tungsten carbide insert brazed into the seat has a base diameter of approximately 0.690 inches. The diameter of the inner wall of the seat was chosen to provide and adequate surface area for the braze to retain the insert in the seat.

The most expensive portion of the cutting tool is the cost of the tungsten carbide insert. It has been found that an insert having a conical forward cutting tip and a frustoconical mid section which widens to the full diameter of the base (about 0.690 inches) is not the most economical configuration to manufacture and use because machines fitted with such tips do not operate at their best efficiency. The problem is that such tips have too great of an outer diameter and require a great amount of horsepower to force the tip against a hard surface. Also, when such machines are used during the hot summer months, the steel tool bodies which retain over sized tungsten carbide inserts become worn and fail long before the inserts.

To reduce the cost of such tools and improve their efficiency, it has been common to provide a tip with a contoured profile in which the forward cutting end diverges outwardly to a maximum useable diameter which is substantially less than that of the diameter of the seat. The tip disclosed in Ojanen, B1 U.S. Pat. No. 4,497,520 depicts such a configuration. Contoured tips such as disclosed by Ojanen, nonetheless employ an excess amount of tungsten carbide to fill the seats into which the inserts are mounted. It would, therefore, be desirable to provide an improved tip having the benefits of the contoured profile but would employ less tungsten carbide and therefor be less expensive to manufacture.

SUMMARY OF THE INVENTION

Briefly, the present invention is embodied in an improved cutting tool having a tool body with a cutting portion and a cylindrical mounting portion sized to fit within the bore of a tool holder on a machine. The cutting end of the tool body has a seat with a general cylindrical wall into which the hardened tungsten carbide insert is brazed.

In accordance with the invention, the tungsten carbide insert has a tip portion, a base portion and a frustoconical mid portion extending from the tip portion to the base portion. The base portion defines a diameter substantially less than the given diameter of the cylindrical wall of a seat. The base further has a plurality of radially extending projections, the outer ends of which define a cylinder having a diameter which is a little less than the diameter of the seat such that the radial projections around the circumference of the base will center the base of the insert within the seat prior to brazing.

GENERAL DESCRIPTION OF THE DRAWINGS

A better and more complete understanding of the present invention will be had after a reading of the following detailed description taken in conjunction with the drawings wherein:

FIG. 1 is a an exploded isometric view of a tool body having an insert in accordance with the present invention;

FIG. 2. Is a somewhat enlarged side elevational view of the insert brazed into the tool body shown as in FIG. 1, the tool body shown in cross section;

FIG. 3 is a further enlarger isometric view of the insert depicted in FIG. 1;

DETAILED DESCRIPTION OF THE PREFERRED EMBODIMENT

Figure 5:
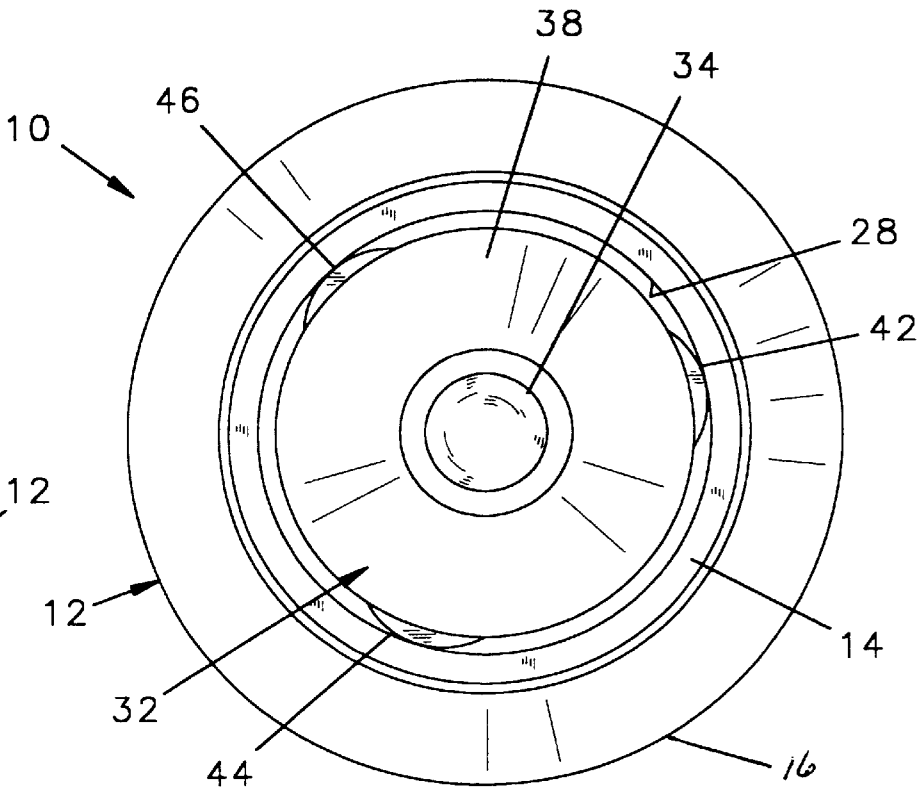
FIG. 5 is an enlarged front elevational view of the tool and insert shown in FIG. 1.
Figure 4:
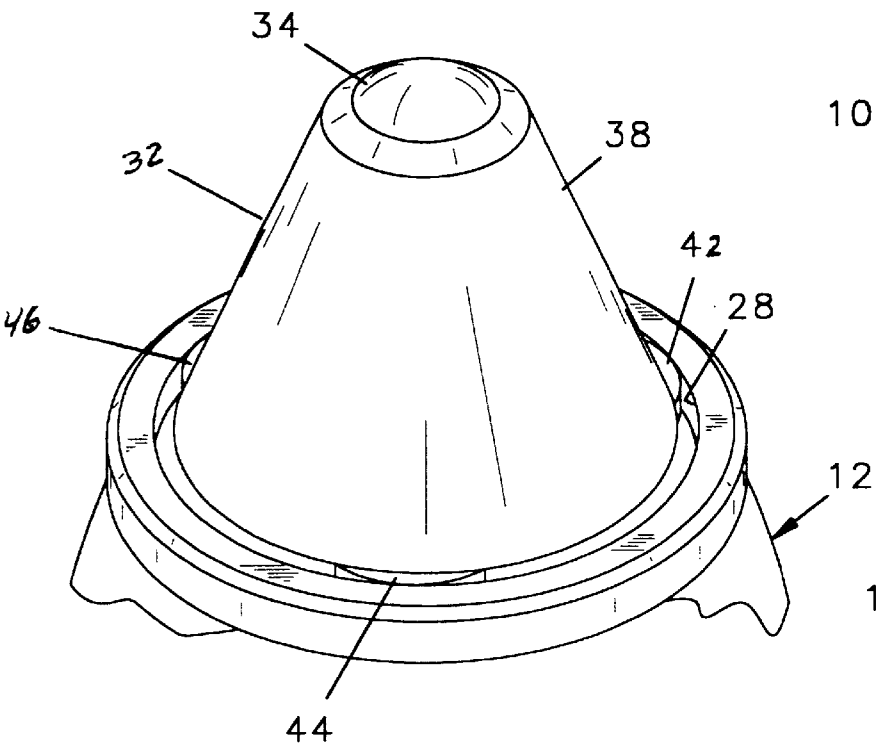
FIG. 4 is a fragmentary enlarged isometric view of the forward end of the tool and insert shown in FIG. 1.

Referring to FIG. 1 through 5, a tool 10 has a forged steel body 12 having a tapered cutting end 14. At the rear of the tapered cutting end 14 is a radial flange 16, and positioned axially behind the radial flange 16 is a cylindrical shank 18 sized to rotatably fit within the bore of a tool holder, not shown.

At the forward end of the tapered cutting end 14 is a seat 24 having a conical floor 26 and a cylindrical outer wall 28. The dimensions of the cylindrical shank 18 are standardize so as to replace the existing tools of a machine and the cylindrical outer wall 28 of the seat 24 also has a standard diameter 30 of about 0.710 inches.

Retained in the seat 24 by braze material 31 is an insert 32 having a domed tip 34 and a generally cylindrical base 36. Extending between the outer circumference of the domed tip 34 to the cylindrical base 36 is a frustoconical midsection 38. The rear surface 39 of the base 36 is conical and is complementary to the shape of the conical floor 26 of the seat 24.

In accordance with the present invention, the cylindrical base 36 has a diameter 40 which is substantially less than the inner diameter 30 of the cylindrical outer wall 28 of the seat 24. The term "substantially less" is used to mean that the difference between the base diameter 40 and the seat diameter 30 is sufficient to allow the base 36 to become so misaligned within the seat as to be noticeable to the naked eye. Preferably the base diameter 40 is about 0.640 inches. The overall height 41 of insert 32 is preferably from 0.550 to 0.750 inches.

Extending radially outward from the cylindrical base 36 are a plurality of protrusions 42, 44, 46, the outer ends of which define a diameter a littler smaller than the given diameter 30 of cylindrical walls 28. By way of example, the outer ends of the protrusions 42, 44, 46 define a diameter 48 of about 0.692 inches, 0.018 inches less than that of the diameter 30 of the cylindrical outer wall 28. When the base 36 is inserted into the seat 24, the protrusions 42, 44, 46 will center the base 36 within the cylindrical outer wall 28 while the parts are brazed together.

Since the base 36 of the insert 32 has a substantially smaller diameter 40 than the given diameter 30 of the seat 24, a substantially lesser amount of tungsten carbide is needed to make the insert 32 than an insert which would fully occupy the seat 24 as is the case of prior art inserts. It has been found that the base 36 can be made with a thickness 49 of about 0.050 inches as opposed to a thickness of about 0.070 as required for inserts of the prior art. Since the cost of tungsten carbide material is the largest single expense in the manufacture of such cutting tools, a tool 10 having an insert 32 can be manufactured at a cost savings of eight cents per tool or more. Furthermore, since the frustoconical midsection 38 of the insert 32 reaches a maximum diameter 40 at the base 36, which is substantially less than the given diameter 30 of the seat 24, a machine employing the tools 10 will operate as efficiently as a machine bearing tools with contoured cutting tips such as disclosed by Ojanen.

Another advantage of a tip made in accordance with the present invention is that the difference between the diameter 30 of the seat 24 and the diameter 40 of the base allows unwanted residual flux to exude through the space between the parts. Allowing the excess flux to exude creates a more consistent and therefore a stronger braze joint. It should be appreciated that the conical shapes of the rear surface 39 of the insert 32 and of the floor 26 of the seat also facilitate in exuding excess flux.

Figure 6:
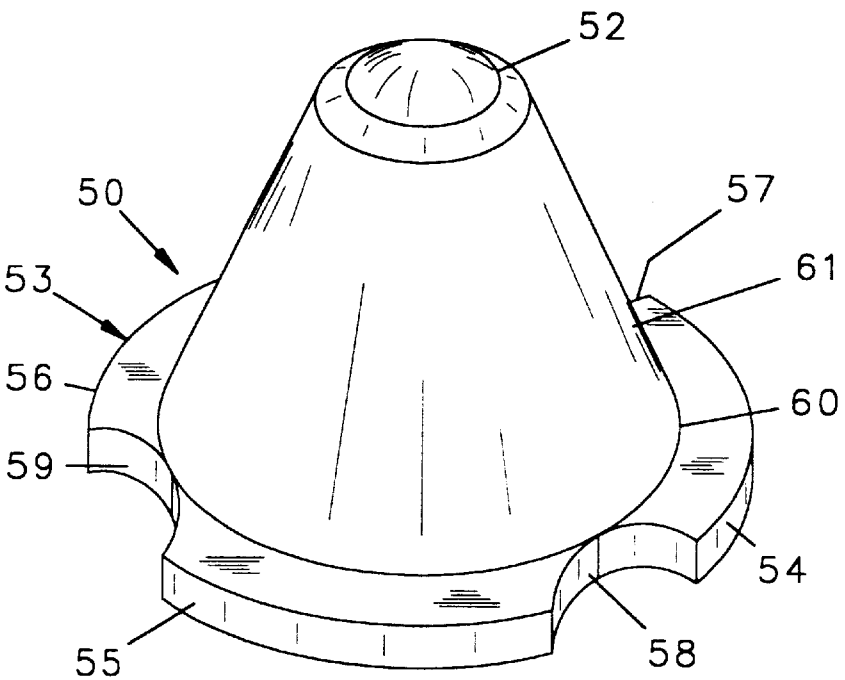
FIG. 6 is an enlarged isometric view of a first alternative embodiment of an insert according to the invention.

Referring to FIG. 6, in a first alternative embodiment the insert 50 has a domed tip 52 and a base 53. In this embodiment the base 53 is irregularly shaped, and includes flanges 54, 55, 56 which define a circle having a diameter which is a little smaller than the inner diameter of the cylindrical outer wall 28 (see FIG. 1) of the tool body 12. In this embodiment a plurality of spaces 57, 58, 59 interrupt the flanges. Inwardly offset a short distance from the diameter defined by the outer portions of flanges 54, 55, 56 is a circular lower end 60 of a frustoconical midsection 61 which extends forwardly to the outer circumference of the tip 52. A small radius or fillet is required at the junction 60 between the midsection 61 and the flanges 54, 55, 56 to distribute stresses within the part.

The larger flanges 54, 55, 56 of insert 50 give it greater strength than insert 32 to bear side forces and the spaces 57, 58, 59 permit unwanted flux to exude during the brazing process.

Figure 7:
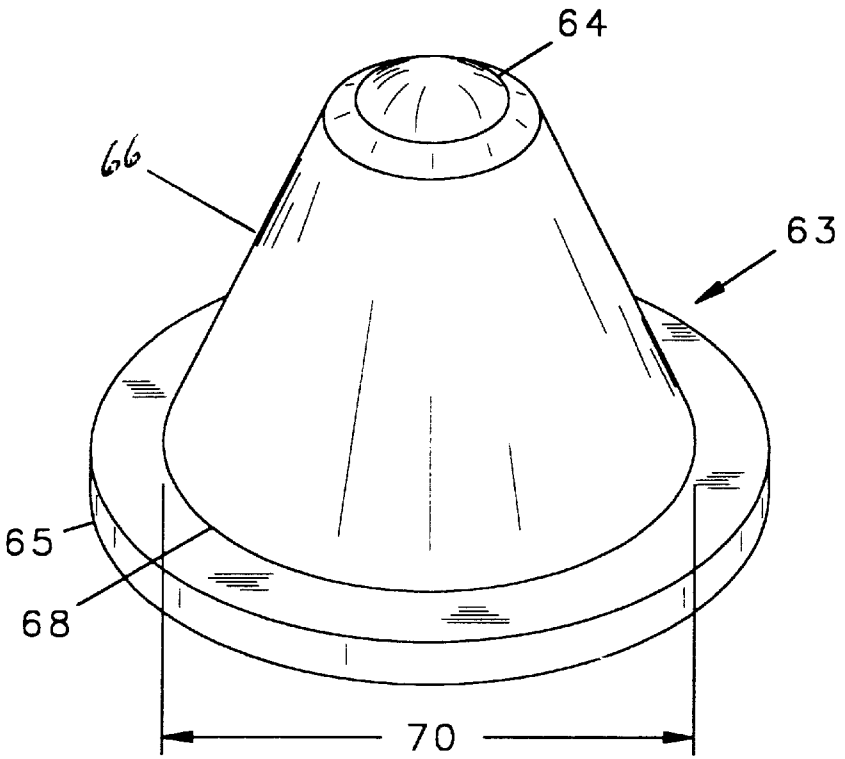
FIG. 7 is an enlarged isometric view of a second alternative embodiment of an insert according to the invention.

Referring to FIG. 7, in a second alternative embodiment an insert 63 has a domed tip section 64, a cylindrical base 65, and a frustoconical midsection 66 which extend from the outer diameter of the tip section 64 to the base 65. The cylindrical base section 65 has a diameter a little less than the diameter 30 of the seat 24, preferably about 0.692 inches, to allow it to be easily inserted therein and brazed in place. The frustoconical midsection 66 reaches its greatest diameter where it intersects the base 65, forming a circular junction 68 which has a diameter 70 that is substantially less than the diameter of the base 65 as shown. A small radius or fillet is needed at the juncture 68 between the base 65 and the midsection 66 to distribute stresses within the part. Preferably circular junction 68 has a diameter 70 of about 0.500 inches. The insert 63 allows little spacing for exuding unwanted flux while it is brazed into the seat 24 of a tool body 12, however, the enlarged base of insert 63 is a little better adapted to bear side loads than the insert 32 described above.

The base flange 65 of insert 63 must be made thicker than the thickness of the protrusions 42, 44, 46 of insert 32 or the flanges 54, 55, 56 of insert 50. During the sintering process the green insert shrinks as it is heated and imperfections in the material causes the insert to shrink somewhat unevenly, and the uneven shrinkage causes stresses within the part. The base flange 65 of insert 63 is configured as a cylinder, and if the base flange 65 is not formed with sufficient thickness, stresses incurred during sintering can lead to cracks to occur at the junction 68 between the midsection 66 and the base 65. The spaces 57, 58, 59 divide the flanges 54, 55, 56 of insert 50 into segments which are not subjected to the same level of stress forces as is the fully cylindrical flange 65. Flange 65 of insert 63 must therefor be made thicker than the minimum thickness needed for flanges 54, 55, 56 of insert 50.

While the present invention has been disclosed with respect to three embodiments, it will be appreciated that many modifications and variations can be made without departing from the true spirit and scope of the invention. It is, therefore, the intent of the appendent claims to cover all such modifications and variations which fall within the true spirit and scope of the invention.

What is claimed:

1. A cutting tool comprising a tool body having a cutting portion and a cylindrical mounting portion positioned axially behind said cutting portion, a seat in a forward end of said cutting portion, said seat having a generally cylindrical wall with a given diameter, a hardened insert in said seat, said insert having a tip portion and a base portion, said base portion defining a cylinder having a diameter substantially less than said given diameter, a plurality of projections extending radially outward of said base portion, said projections having outer ends defining a diameter a little less than said given diameter wherein said plurality of projections centrally position said base within said seat, said base having arcuate portions wherein each of said arcuate portions is a portion of said cylinder defined by said base, said arcuate portions having an angular width about a circumference of said base, said projections having an angular width about said circumference of said base, said angular width of said arcuate portions being at least twice said angular width of said projections, and said insert bonded into said seat.

2. A cutting tool in accordance with claim 1 wherein said projections on said base of insert have an upper surface defining a plane, and said plane defined by said upper surface is perpendicular to a longitudinal axis of said tool.

3. A hardened insert for brazing into the seat of a tool body, said seat having cylindrical walls and a given diameter, said insert comprising a tip portion and a base portion, said base portion defining a cylinder having a diameter substantially less than said given diameter, a plurality of projections extending radially outward of said base portion, said projections having outer ends defining a diameter a little less than said given diameter wherein said plurality of projections centrally positions said base within said seat, said base having arcuate portions wherein each of said arcuate portions is a portion of said cylinder defined by said base, said arcuate portions having an angular width about a circumference of said base, said projections having an angular width about said circumference of said base, and said angular width of said arcuate portions being at least twice said angular width of said projections.

4. A hardened insert in accordance with claim 3 wherein said projections have an upper surface, and said upper surfaces define a plane perpendicular to a longitudinal axis of said insert.

* * * * *